US011260312B1

(12) United States Patent
Asano

(10) Patent No.: US 11,260,312 B1
(45) Date of Patent: Mar. 1, 2022

(54) WALL RIDING VEHICLE

(71) Applicant: MerchSource, LLC, Irvine, CA (US)

(72) Inventor: Mitsunori Asano, Chiba (JP)

(73) Assignee: MerchSource, LLC, Irvine, CA (US)

( * ) Notice: Subject to any disclaimer, the term of this patent is extended or adjusted under 35 U.S.C. 154(b) by 0 days.

(21) Appl. No.: 17/060,116

(22) Filed: Oct. 1, 2020

(51) Int. Cl.

| | |
|---|---|
| ***A63H 17/26*** | (2006.01) |
| ***A63H 33/00*** | (2006.01) |
| ***A63H 27/00*** | (2006.01) |
| ***A63H 30/02*** | (2006.01) |

(52) U.S. Cl.
CPC ..... *A63H 17/262* (2013.01); *A63H 27/12* (2013.01); *A63H 33/003* (2013.01); *A63H 30/02* (2013.01)

(58) Field of Classification Search
CPC .... A63H 17/00; A63H 17/004; A63H 17/262; A63H 17/28; A63H 27/04; A63H 27/12; A63H 30/02; A63H 33/003
USPC ..... 446/438, 448, 454, 457, 465
See application file for complete search history.

(56) References Cited

U.S. PATENT DOCUMENTS 3,810,515 A * 5/1974 Ingro ..... B61B 13/08 180/54.2
3,926,277 A * 12/1975 Shino ..... A47L 5/36 180/164
4,813,907 A * 3/1989 Rissman ..... A63H 3/28 446/175
4,964,835 A * 10/1990 Suto ..... A63H 18/002 446/154
4,971,591 A * 11/1990 Raviv ..... A63H 17/26 180/164
5,194,032 A * 3/1993 Garfinkel ..... A63H 17/004 180/164
5,269,718 A * 12/1993 Reed ..... A63H 17/00 446/176
6,028,533 A * 2/2000 Javors ..... A63H 17/32 340/13.31
6,520,824 B1 * 2/2003 Caroselli ..... A63H 27/10 446/225
7,231,997 B2 * 6/2007 De Roche ..... A63H 27/12 180/116
7,234,992 B2 * 6/2007 Weiss ..... A63H 17/28 446/454
7,753,755 B2 7/2010 Clark, Jr. et al.
7,959,104 B2 6/2011 Kuntz
7,980,916 B2 7/2011 Clark, Jr. et al.
8,702,466 B2 * 4/2014 Cheng ..... A63H 27/12 446/36
8,979,609 B2 3/2015 Clark, Jr. et al.
(Continued)

*Primary Examiner* — Joseph B Baldori
(74) *Attorney, Agent, or Firm* — Renner, Otto, Boisselle & Sklar, LLP

(57) ABSTRACT

A toy vehicle includes a chassis, wheels connected to an exterior of the chassis and configured to move on a surface, at least two propellers connected to an interior of the chassis independently from the plurality of wheels, the at least two propellers being configured to counterrotate relative to each other thereby generating airflow outwardly from the chassis in a first direction that is normal to a rotational plane of the at least two propellers whereby the chassis is urged in a second direction opposite the first direction against the surface, at least one first drive motor operatively connected to the plurality of wheels for driving the plurality of wheels, and at least one second drive motor operatively connected to the at least two propellers for driving the at least two propellers.

19 Claims, 9 Drawing Sheets

(56) References Cited

U.S. PATENT DOCUMENTS

| | | | | |
|---|---|---|---|---|
| 9,061,763 | B1 * | 6/2015 | Christensen | B64C 27/32 |
| 9,364,766 | B2 | 6/2016 | Mielniczek | |
| 9,675,897 | B2 | 6/2017 | Clark, Jr. et al. | |
| 9,738,337 | B2 * | 8/2017 | Li | B62D 57/024 |
| 9,789,415 | B2 | 10/2017 | Mielniczek | |
| 10,023,309 | B2 * | 7/2018 | Brown | B64D 47/06 |
| 10,059,437 | B2 * | 8/2018 | Cooper | A63H 27/12 |
| 10,112,664 | B2 * | 10/2018 | Li | G01N 29/265 |
| 10,220,896 | B2 * | 3/2019 | Kazakov | B62D 55/265 |
| 10,398,995 | B2 | 9/2019 | Clark, Jr. et al. | |
| 10,464,620 | B2 * | 11/2019 | Arigoni | G05D 1/08 |
| 10,579,863 | B2 * | 3/2020 | Volkart | G06K 9/00771 |
| 2007/0105474 | A1 * | 5/2007 | Gotou | A63H 30/04 446/37 |
| 2009/0124162 | A1 * | 5/2009 | Martino | A63H 17/00 446/57 |
| 2017/0177925 | A1 * | 6/2017 | Volkart | B64C 39/024 |
| 2020/0254355 | A1 * | 8/2020 | Wang | A63H 29/10 |

* cited by examiner

WALL RIDING VEHICLE

FIELD OF INVENTION

The present invention relates to a remote-controlled motorized toy vehicle that is capable of operation on wall and/or ceiling surfaces.

BACKGROUND

Radio-controlled motorized toy vehicles are driven by motors and steered in response to commands that are transmitted remotely. Conventional toy vehicles are limited to floor surfaces that are substantially horizontal due to gravity. Prior attempts to provide motorized toy vehicles that are able to climb vertical walls include implementing suction-adhering propulsion systems that use a vacuum pump to draw air from a sealed interior of the vehicle. The air pressure acting on the outer surface of the vehicle forces the vehicle against the wall. Accordingly, a seal must be formed between the periphery of the toy vehicle and the fixed surface, such as via a venturi duct. However, toy vehicles using suction-adhering propulsion have deficiencies in providing and maintaining a functional seal and in overcoming the friction between the sealing member and the wall that impedes the motion of the device.

SUMMARY OF INVENTION

The present application provides a toy vehicle having motor-driven wheels and propellers that are configured to counterrotate relative to each other. The counterrotating propellers generate airflow outwardly from the toy vehicle to urge the vehicle against a surface along which the toy vehicle is traveling, such as a wall or ceiling. The propellers are supported by an interior of a chassis of the motor vehicle, independently relative to the wheels which are connected to an exterior of the chassis. The wheels and the propellers may be driven by separate motors. Such motor configuration is advantageous in that the propellers are able to provide a thrust for the toy vehicle without impeding the motion of the toy vehicle such that the toy vehicle is able to smoothly traverse any non-horizontal surface.

The toy vehicle may further include a protective casing for the propellers. The protective casing may extend over an entire rotational plane of the propellers to prevent contact with the propellers. A plurality of air flow openings are formed in the protective casing to enable air flow passage from the propellers. In an exemplary embodiment, the protective casing may include a grid-like structure having openings that are large enough to enable air flow passage and small enough to prevent the fingers of a user from being able to access the propellers.

Two sets of wheels may be arranged on each side of the toy vehicle. In one embodiment, three wheels are provided in each set and each of the wheels may be rotatable about a fixed axis relative to the chassis. Other embodiments may have more or less than three wheels in each set. The wheels may be identical in shape and size, and uniformly aligned. A side bracket may be mounted to the chassis and supports all of the wheels. A gear wheel arrangement may be provided between the wheel drive motor and at least one of the wheels to transmit rotational force to at least one of the wheels, such as a front or lead wheel. The arrangement of the wheels is advantageous in enabling a lead wheel to contact a surface to which the toy vehicle is moving while the rear wheel maintains contact with the surface from which the toy vehicle is moving. During the transition of the toy vehicle between surfaces, the middle wheel may not engage either of the surfaces. The thrust provided by the propellers forces the wheels into engagement against the corresponding surface.

The toy vehicle may further include any suitable lighting or sound features, such as light-emitting diodes, light pipes, or a noise cancellation device configured to minimize the noise of the propellers.

According to an aspect of the invention, a toy vehicle includes motor-driven wheels and propellers that provide thrust for the toy vehicle to enable the toy vehicle to traverse floors, walls, and ceilings.

According to an aspect of the invention, a toy vehicle includes a chassis, wheels that are mounted to an exterior of the chassis, and propellers supported by an interior of the chassis independently relative to the wheels.

According to an aspect of the invention, a toy vehicle includes two sets of three identical wheels that are arranged on opposite sides of the toy vehicle.

According to an aspect of the invention, a toy vehicle includes wheels, propellers, and a protective casing for the propellers that enables air flow passage while also preventing access to the propellers.

According to an aspect of the invention, a toy vehicle includes wheels, propellers, and a noise cancellation device for the propellers.

According to an aspect of the invention, a toy vehicle includes a chassis, a plurality of wheels connected to an exterior of the chassis, the plurality of wheels being configured to support the chassis and move on a surface, at least two propellers supported by an interior of the chassis independently from the plurality of wheels, the at least two propellers being configured to counterrotate relative to each other thereby generating airflow outwardly from the chassis in a first direction that is normal to a rotational plane of the at least two propellers whereby the chassis is urged in a second direction opposite the first direction against the surface, at least one first drive motor operatively connected to the plurality of wheels for driving the plurality of wheels, and at least one second drive motor operatively connected to the at least two propellers for driving the at least two propellers.

According to an aspect of the invention, a method of assembling a toy vehicle includes connecting a plurality of wheels to an exterior of a chassis to support the chassis, mounting at least two propellers to an interior of the chassis independently from the plurality of wheels, the at least two propellers being configured to counterrotate relative to each other thereby generating airflow outwardly from the chassis in a first direction that is normal to a rotational plane of the at least two propellers whereby the chassis is urged in a second direction opposite the first direction against the surface, operatively connecting at least one first drive motor to the plurality of wheels for driving the plurality of wheels, and operatively connecting at least one second drive motor to the at least two propellers for driving the at least two propellers.

Other systems, devices, methods, features, and advantages of the present invention will be or become apparent to one having ordinary skill in the art upon examination of the following drawings and detailed description. It is intended that all such additional systems, methods, features, and advantages be included within this description, be within the scope of the present invention, and be protected by the accompanying claims.

DETAILED DESCRIPTION

Figure 1:
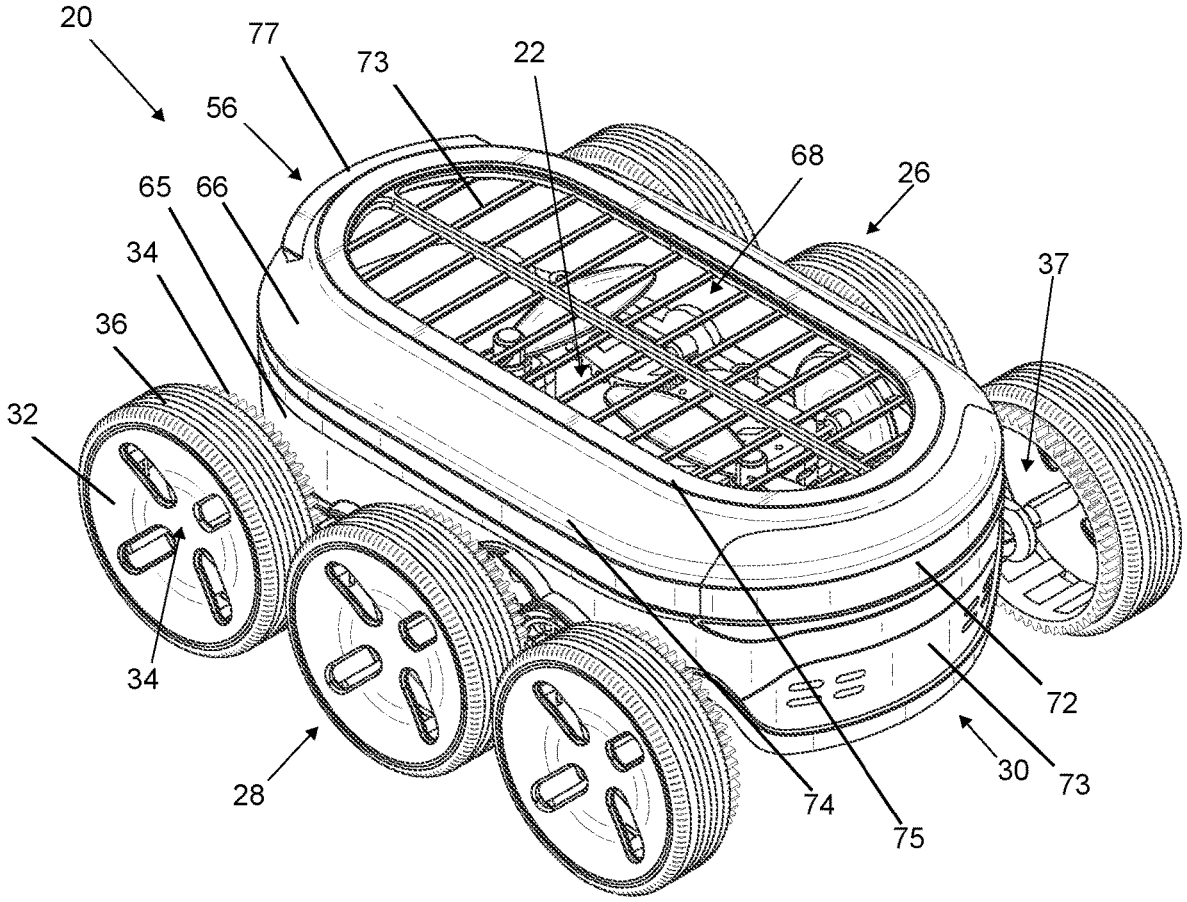
FIG. 1 shows an oblique side view of a toy vehicle according to an exemplary embodiment of the present application in which the toy vehicle includes counterrotating propellers that provide thrust for the toy vehicle.

Aspects of the present application pertain to a vehicle or toy vehicle that includes a chassis and at least two propulsion systems. An exemplary application for the toy vehicle is the toy industry in which the toy vehicle is a radio or remote-controlled vehicle. Other applications may also be suitable. For example, a camera or imaging device may be implemented in the vehicle such that the vehicle may be used for surveillance, such as in defense applications, or for filming a movie. In still other applications, the vehicle may be configured to carry a load or package. Other suitable applications may implement the vehicle to reach a location that is difficult to access. Many other applications may be suitable.

FIGS. 1-8 show a toy vehicle 20 according to an exemplary embodiment. The toy vehicle 20 includes a chassis 22 and a plurality of wheels 24 connected to the chassis 22. The plurality of wheels 24 may support the chassis 22 about a surface and are configured to move on the surface. Two sets of wheels 26, 28 are provided and arranged on opposite sides of the chassis 22 relative to a direction in which the toy vehicle 20 is configured to travel. For example, a first set of wheels 26 may be arranged on a left side of the chassis 22 and a second set of wheels 28 may be arranged on a right side of the chassis 22, relative to a front end 30 of the toy vehicle 20. Each set of wheels 26, 28 includes the same number of wheels 24, such as two or more. As shown in FIGS. 1-4, each set of wheels 26, 28 includes three wheels, but more or less than three wheels may be included.

The wheels 24 may have any suitable shape and size, and all of the wheels 24 may be identical in shape and size. All of the wheels 24 may be sized to be larger than the chassis 22 as the diameter of the wheels 24 may be greater than half a total height of the toy vehicle 20. As best shown in FIG. 1, each wheel 24 preferably includes a spoke framework 32 having a central hub 34 for mounting the wheel 24 to the chassis 22. The wheels 24 may be fixedly mounted for rotation relative to the chassis 22 meaning that the rotational plane of the wheels 24 will always have a same orientation relative to the chassis 22. The spoke framework 32 may be arranged along a side of the wheel 24 opposite to a side of the wheel 24 proximate the chassis 22. In an exemplary embodiment, the spoke framework 32 may have a tapering or truncated cone surface that tapers inwardly toward the chassis 22. The wheels 24 are connected to the exterior of the chassis 22 such that the chassis 22 is interposed between the sets of wheels 26, 28.

A peripheral wheel surface 36 extends outwardly from the spoke framework 32 toward the chassis 22 and defines an open interior cavity 37 in the wheel 24. A gripping surface 38 may be formed on the peripheral wheel surface 36 and enables the toy vehicle 20 to move along any suitable terrain. Two gripping surfaces 38 may be formed along the side edges of the wheel 24 and the gripping surfaces 38 may be formed as spaced ridges or teeth that protrude from the circumference of the wheel 24. The wheels 24 may be formed of any suitable materials. For example, the spoke framework 32 and the peripheral wheel surface 36 may be formed of a metal or plastic material, and the gripping surface 38 may be formed of a rubber material. Many other materials and shapes of the wheels 24 may be suitable.

Figure 2:
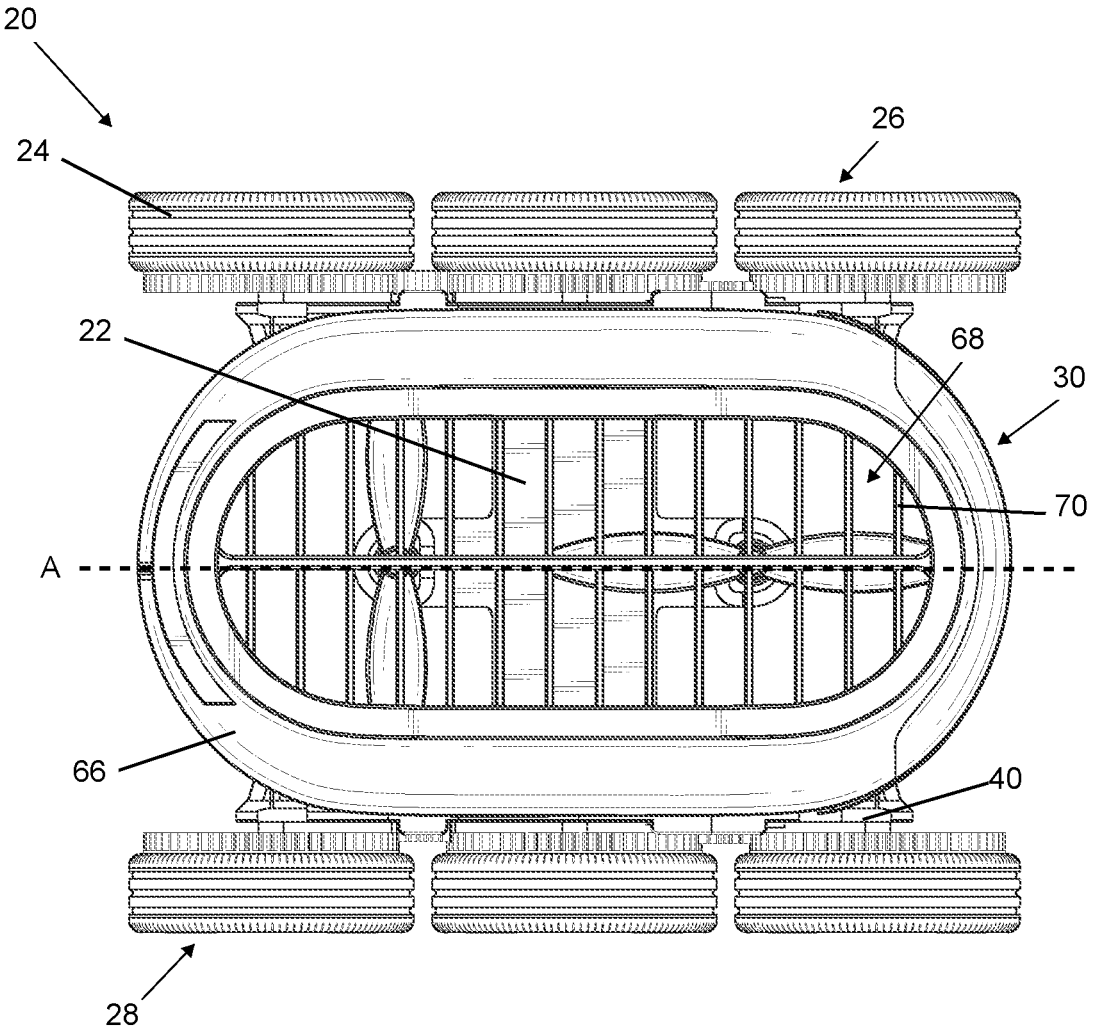
FIG. 2 shows a top view of the toy vehicle of FIG. 1.
Figure 3:
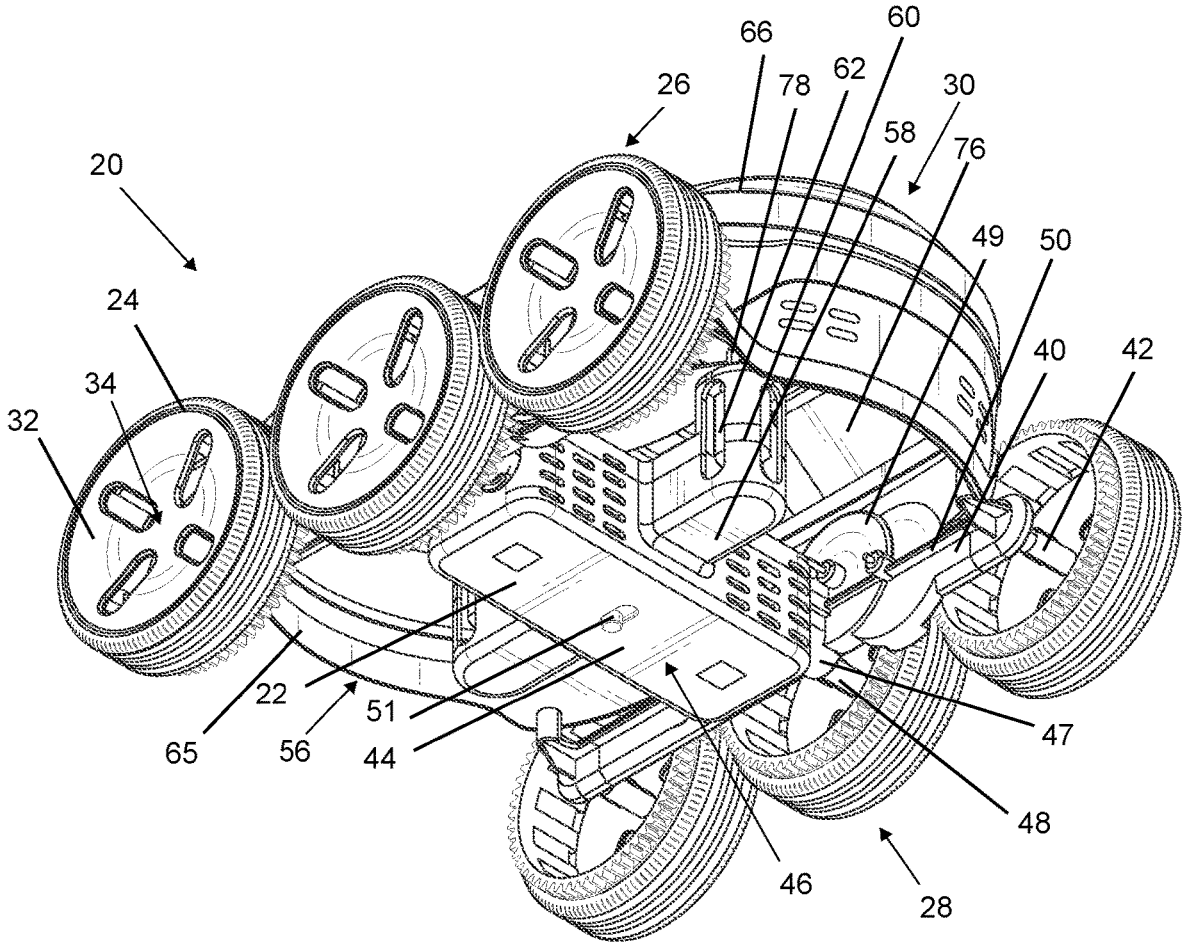
FIG. 3 shows a bottom oblique view of the toy vehicle of FIG. 1.

As best shown in FIGS. 2 and 3, side brackets 40 are arranged on each side of the chassis 22 and have a corresponding set of wheels 26, 28 mounted thereto. The side brackets 40 may extend parallel with each other on a left side and a right side of the chassis 22. The central hub 34 of each wheel 24 is mounted to the corresponding side bracket 40 and each of the wheels 24 in the corresponding set of wheels 26, 28. The wheels 24 may be arranged uniformly along the corresponding side bracket 40 such that all of the wheels 24 in a set of wheels 26, 28 have a same diameter and are adjacently aligned.

The spacing between each of the wheels 24 may be the same and the spacing may be relatively small. For example, two adjacent wheels 24 may be spaced by fewer than several centimeters. In other exemplary embodiments in which the wheel sizes are varied, the spacing between the wheels may also be varied. The wheels 24 may be fixedly positioned relative to the side bracket 40 such that the rotational plane of the wheel 24 will always be parallel relative to the extension direction of the side bracket 40. The side bracket 40 may have any suitable shape and dimensions for supporting a corresponding set of wheels 24.

In an exemplary embodiment, the side brackets 40 may be formed as unitary members that each have a length that is elongated along an axis that is parallel to a central axis A of the chassis, as shown in FIG. 2. The central axis A extends parallel with a direction of travel in which the toy vehicle 20 is configured to move. The toy vehicle 20 may be formed to be substantially symmetrical along the central axis A such that the chassis 22, wheels 24, side brackets 40, etc. are mirrored along the central axis A. As best shown in FIG. 3, the central hub 34 of each wheel 24 includes an axle 42 extending from the spoke framework 32 to the side bracket 40 for supporting the wheel 24. The axles 42 may extend perpendicular to the central axis A shown in FIG. 2.

Figure 4:
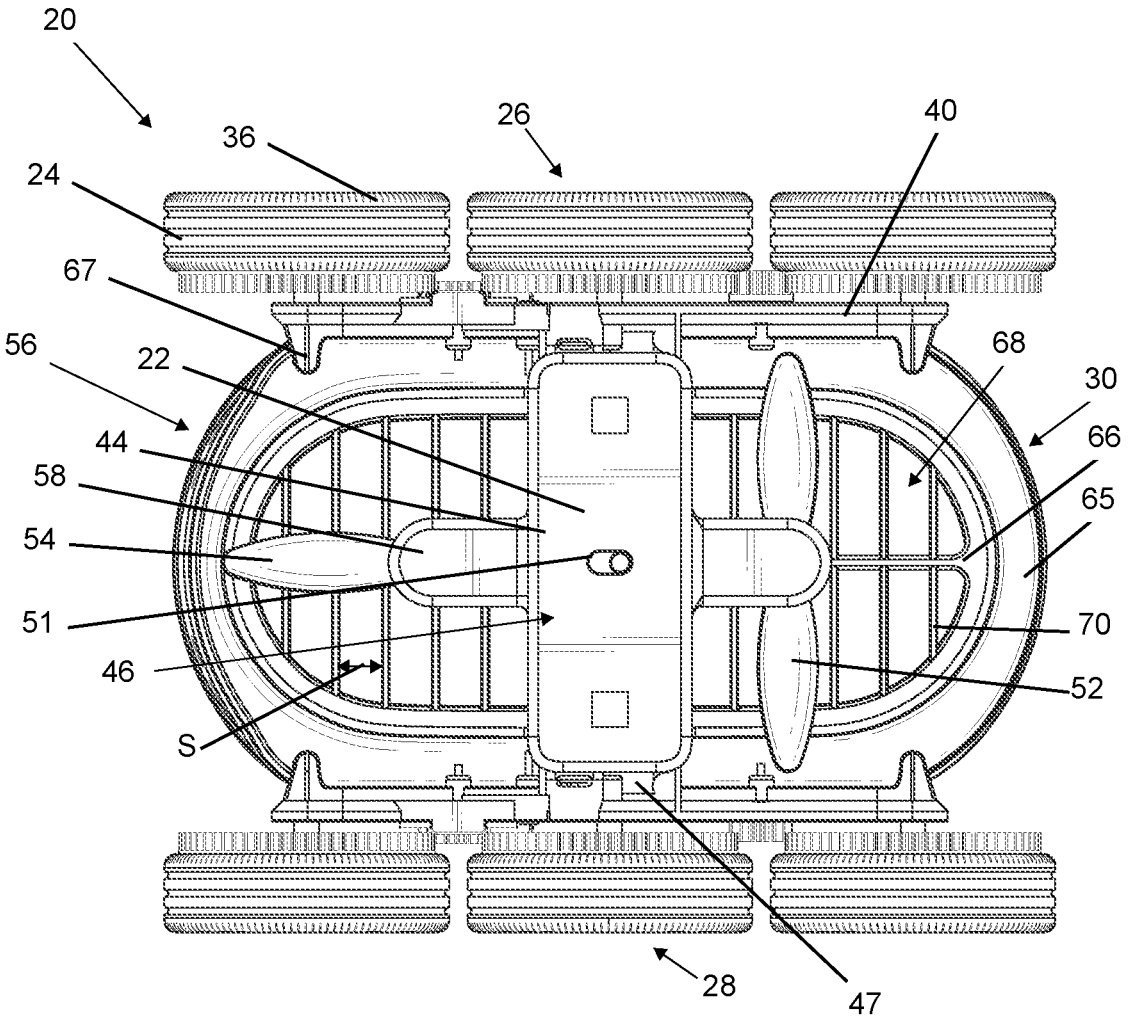
FIG. 4 shows a bottom view of the toy vehicle of FIG. 1.

Referring in addition to FIG. 4, the chassis 22 includes a main body 44 that houses a power source 46 for the toy vehicle 20. Any suitable power source or energy storage device may be used. In an exemplary embodiment, a rechargeable battery may be housed in the main body 44. The main body 44 defines an interior of the chassis 22 and is arranged between the sets of wheels 26, 28. Connectors 47 may be connected between the main body 44 and an axle 48 of the middle wheel 24 in the set of wheels 26, 28. The connectors 47 may house a drive shaft of a corresponding wheel drive motor that is supported in the main body 44 and extend into the axle 48 of the middle wheel 24 for driving the middle wheel 24.

In an exemplary embodiment, the connectors 47 may be formed integrally with the main body 44 as a single monolithic part. In other exemplary embodiments, the connectors 47 may be formed separately or as part of a separate frame that is connected to the main body 44. The connectors 47 may have any suitable shape that is configured to support and connect axles and drive members of the propulsion system.

As shown in FIG. 3, a gear wheel arrangement including a plurality of gear wheels 49 may be connected to the connector 47 and rotatable by the drive shaft of the wheel drive motor. The side brackets 40 may support the gear wheels 49 and power supply lines 50 that are embedded in the side brackets 40 and coupled to each of the wheels 24. Any configuration and sizes of gear wheels 49 may be suitable and the size and arrangement of the gear wheels 49 may be selected to provide a predetermined transmission ratio to a corresponding wheel. The wheel drive motor may thus be connected to the power source 46 in the main body 44 and the wheels 24 through the connectors 47, the gear wheels 49, and the power supply lines 50. The main body 44 may further include an activation button 51 for activating and deactivating the power source 46, i.e. for turning the toy vehicle 20 on and off.

In an exemplary embodiment, one wheel drive motor is provided for each set of wheels 26, 28. In other embodiments, one wheel drive motor may be used to drive all of the wheels 24. The drive shaft of the wheel drive motor is connected to the axle 48 of the middle wheel of the set of wheels 26, 28 such that the wheel drive motor directly drives the middle wheel. The gear wheels 49 are connected between the drive shaft of the wheel drive motor and a lead or front wheel of the set of wheels 26, 28 such that rotary motion is transferred to the front wheel. The rear wheels may be freely rotating without a gear arrangement or another gear wheel arrangement may also be provided to drive the rear wheels. Many different configurations of the wheels may be provided.

As best shown in FIG. 4, in another propulsion system for the toy vehicle 20, at least two propellers 52, 54 are connected to the main body 44. The propellers 52, 54 are supported on an interior of the chassis 22 independently relative to the wheels 24 that are mounted to an exterior of the chassis 22. The propellers 52, 54 are thus not supported by or mounted to the wheels 24. The at least two propellers 52, 54 includes a front propeller 52 arranged proximate the front end 30 of the toy vehicle 20 and a rear propeller 54 arranged proximate a rear end 56 of the toy vehicle 20. In other exemplary embodiments, more than two propellers 52, 54 may be provided. Each propeller 52, 54 may have two aligned and elongated blades, but other configurations of the propellers 52, 54 may be suitable. Any suitable materials may be used to form the propellers 52, 54, such as plastic or metal materials.

The propellers 52, 54 are configured to counterrotate relative to each other in a rotational plane that is parallel with the ground surface along which the toy vehicle 20 travels. The rotational plane of the propellers 52, 54 is perpendicular with the rotational plane of the wheels 24. Each of the propellers 52, 54 may be arranged and aligned along the central axis A (shown in FIG. 2). The rotational plane is defined between the sets of wheels 26, 28 and does not intersect or overlap with the rotational plane of the wheels 24. Due to the counterrotation of the propellers 52, 54, airflow is generated outwardly or upwardly from the chassis 22 in a first direction that is normal to the rotational plane of the propellers 52, 54. Accordingly, the chassis 22 and toy vehicle 20 are urged in a second direction opposite the first direction of the airflow to engage against the surface along which the toy vehicle 20 travels.

Using the propellers 52, 54 is advantageous in that the toy vehicle 20 is able to travel along any suitable surface including vertical wall surfaces and horizontal ceilings, and any non-horizontal or angled surfaces. The configuration of the wheels 24 is also advantageous in enabling the toy vehicle 20 to transition from a first surface to an adjacent surface, such as a floor to a wall, a wall to another wall, or a wall to a ceiling. For example, in the set of wheels 24, 26 that includes three wheels having the same size and alignment relative to the chassis 22, during the transition from the wall to the other wall or ceiling, the lead or front wheel may grip the other wall or ceiling and the rear wheel may grip the wall from which the vehicle 20 is transitioning, such that the middle wheel is free from engagement with any wall or ceiling. The thrust provided by the propellers 52, 54 holds the toy vehicle 20 against the surfaces during the transition to all three wheels 24 moving from one surface to another.

As shown in FIGS. 3 and 4, a support structure for the propellers 52, 54 includes arms 58 connected between the main body 44 and propeller housings 60 that support propeller motors 62 for driving the propellers 52, 54. The propeller housings 60 are spaced along the central axis A of the toy vehicle 20 (shown in FIG. 2). In an exemplary embodiment, the propeller housings 60 and the arms 58 may form a monolithic unitary frame that supports both propellers 52, 54 and is attached to the main body 44. In other exemplary embodiments, a propeller support structure may be formed integrally with the main body 44. The main body 44 may include other integrally formed structural support members, such as connectors 47. In other embodiments, connectors and support members may be formed separately and subsequently assembled.

The connectors 47 extend from sides of the main body 44 whereas the arms 58 of the propeller support structure extend from a front end of the main body 44 and a rear end of the main body 44. The main body 44 may have a width from side-to-side that is greater than a length from the front end to the rear end. The arms 58 may extend perpendicular relative to the connectors 47, such that the drive shafts of the drive motors for the wheels extend perpendicular relative to the drive shafts of the propeller drive motors. All of the arms 58 and the connectors 47 may extend in a plane that is parallel with the rotational plane of the propellers 52, 54. The plane of extension for the arms 58 and the connectors 47 is arranged below the propellers 52, 54. The propeller housings 60 extend perpendicular relative to the rotational plane of the propellers 52, 54, and the propeller housings 60 are arranged adjacent the main body 44.

As best shown in FIGS. 1, 3, and 4, a chassis casing 65 is arranged to surround the propeller housings 60 and the propeller motors 62. As shown in FIGS. 1-4, a protective shell or casing 66 is removably attached to the chassis casing 65 and is configured to provide a rigid structure that protects the propellers 52, 54. The protective casing 66 may have any suitable shape and is formed to extend over an entire rotational plane of the propellers 52, 54. A suitable shape may be an elongated oval shape, as shown in FIGS. 1-4. The chassis casing 65 may have a shape that is complementary to the shape of the protective casing 66.

As shown in FIG. 4, the side brackets 40 corresponding to the wheels 24 may include a plurality of posts or attachment points 67 that are configured to engage the chassis casing 65 and secure the chassis casing 65 relative to the side brackets 40. The attachment points 67 may include complementary engaging surfaces, a snap-fit engagement, tongue and groove engagement, clamping or clasping engagement, slider arrangement, or any other suitable connection. The attachment points 67 may be formed integrally with the side brackets 40. Similar attachment configurations may be used to secure the chassis casing 65 and the protective casing 66 which may have complementary mating surfaces.

The wheels 24 are arranged outside an outer perimeter of the protective casing 66 such that the wheels 24 are arranged outside the area which is enclosed by the chassis casing 65 and the protective casing 66. Accordingly, the rotational plane of the wheels 24 is arranged outside the protective casing 66 whereas the rotational plane of the propellers 52, 54 is arranged inside the protective casing 66. Any suitable rigid material may be used to form the chassis casing 65 and the protective casing 66, such as a metal or plastic material. The material may be a lightweight plastic material. As best shown in FIGS. 1, 2, and 4, at least one opening 68 is formed in the protective casing 66 to enable airflow from the propellers 52, 54 through the protective casing 66. A plurality of openings 68 may be provided and the openings 68 may be formed to have a particular pattern to enable a certain amount of airflow. The pattern of the openings 68 may be formed to have a symmetrical pattern.

The protective casing 66 may include a grid frame formed of rigid bars 70. The bars 70 may define the openings 68. The pattern of the bars 70 may be uniform or non-uniform. The spacing between the bars 70 may be selected to be large enough to enable airflow through the openings 68 from the propellers 52, 54, while also being small enough to prevent the fingers of a user from accessing the propellers 52, 54. For example, as shown in FIG. 4, a spacing S between the bars 70 may be several centimeters or less. The spacing S between all of the bars 70 may be the same or may vary. Most of the bars 70 may extend perpendicular relative to the central axis A of the toy vehicle 20 (shown in FIG. 2). At least one bar 70 may extend along the central axis A or along an axis that is parallel with the central axis A to form the grid frame.

As shown in FIG. 1, the protective casing 66 may be formed to have an aero-dynamic structure such that the protective casing 66 is tapered toward the front end 30 of the toy vehicle 20. The protective casing 66 may have a front panel 72 that extends downwardly at the front end 30 of the toy vehicle 20. The chassis casing 65 also has a front panel 73 that is flush with the front panel 72 of the protective casing 66 and may be formed to contact a surface, such as a wall, to protect the components of the toy vehicle 20, such as the propeller housings 60. A forward-most surface of the toy vehicle 20 may be defined by the front panel 72 of the protective casing 66 and the front panel 73 of the chassis casing 65.

Sides 74 of the protective casing 66 may also be angled downwardly and outwardly from a top surface 75 of the protective casing 66. The top surface 75 may be substantially planar and parallel with the surface along which the toy vehicle 20 travels. The front panel 72, top surface 75, and sides 74 may be formed as a continuous surface. As best shown in FIG. 3, sides 76 of the chassis casing 65 may engage the side bracket 40 and extend outside the gear wheels 49 to protect the gear wheels 49. A fin 77 or other aerodynamic features may be formed at the rear end 56 of the protective casing 66. Many different shapes may be suitable for the protective casing 66 and the chassis casing 65, including dome-like shapes, prisms, truncated cones, rectangles, etc.

As also shown in FIG. 3, the propeller housing 60 extends between the main body 44 of the chassis 22 and upwardly toward the protective casing 66. The propeller motors 62 and propeller shafts 78 that extend from the propeller motors 62 are supported by the propeller housings 60 and extend upwardly from the propeller housings 60 toward the protective casing 66, such that the propellers 52, 54 are arranged at a location along the corresponding propeller shaft 78 between the main body 44 and the protective casing 66.

The chassis casing 65 is formed as a continuous surface that surrounds the propeller housings 60 at the front end 30 and the rear end 56 of the toy vehicle 20. The continuous surface of the chassis casing 65 defines a perimeter that is arranged exterior relative to the chassis 22 and interior relative to the wheels 24. Using the protective structures of both the chassis casing 65 and the protective casing 66 is advantageous to prevent the propellers 52, 54 and propeller motors 62 from engaging with a surface that would interfere with the operation of or damage the propellers 52, 54.

Figure 5:
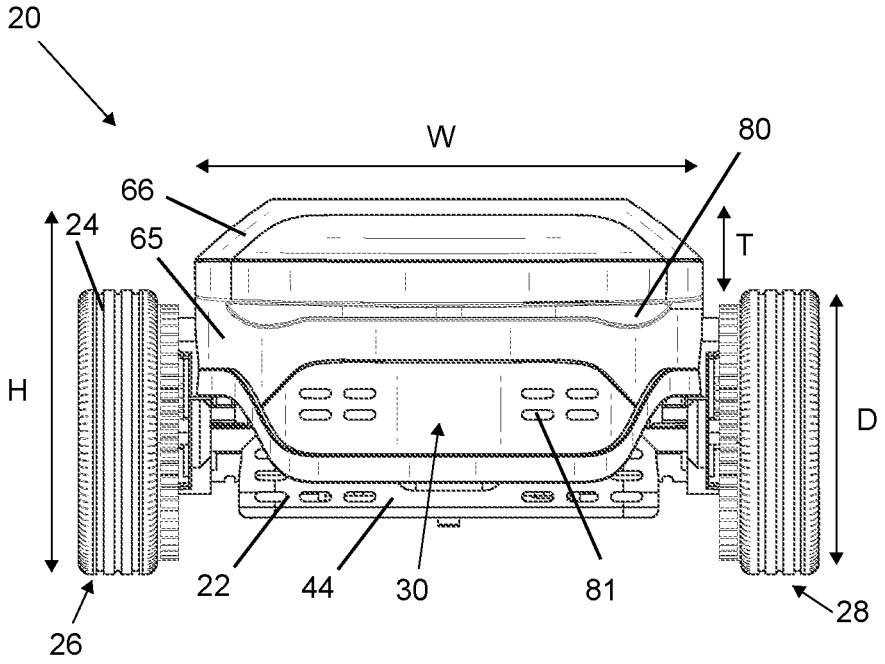
FIG. 5 shows a front view of the toy vehicle of FIG. 1.

Referring in addition to FIG. 5, the protective casing 66 may have a thickness T in the direction of a height H of the toy vehicle 20 that is less than the diameters D of the wheels 24. The diameter D of the wheels 24 may be greater than half of the height H of the toy vehicle 20. The thickness T of the protective casing 66 is less than a length and the width W of the protective casing 66. The length of the protective casing 66 extends along the central axis A (shown in FIG. 2) and is longer than the width W of the protective casing 66 that extends between sides. The wheels 24 are arranged outside the outer width W of the protective casing 66 and the chassis casing 65 which may be the same. FIG. 5 also shows the symmetrical arrangement of the protective casing 66 and the chassis casing 65.

As also shown in FIG. 5, a light pipe 80 may be supported by the chassis casing 65 and/or the protective casing 66 and is configured to guide light between LEDs arranged about the toy vehicle 20. The LEDs may be powered by the power source arranged in the main body 44 of the chassis 22. Lighting windows 81 may also be formed on the chassis casing 65 for lighting by the LEDs and/or light pipes 80. Accordingly, the toy vehicle 20 may be illuminated at the front end 30 and along the bottom of the toy vehicle 20. Many different arrangements of the light pipe 80, lighting windows 81, and LEDs may be suitable. In one embodiment, an LED configuration of different colors may be used to differentiate the front of the vehicle from the rear. For example, the front may have LEDs of one color, while the rear has LEDs of a different color. Alternatively, LEDs may be present only on the front or the rear, which can facilitate user identification of the orientation of the vehicle. Alternatively, the LEDs may be positioned differently on the front and rear of the vehicle. Combinations of such configurations may be used to help a user differentiate the front and rear of the vehicle, particular when it is traveling when on a ceiling.

Figure 6:
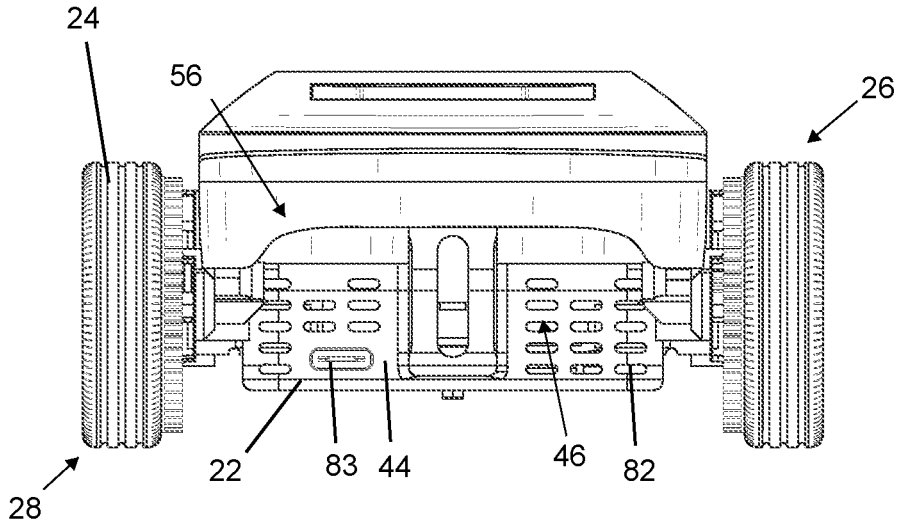
FIG. 6 shows a rear view of the toy vehicle of FIG. 1.

FIG. 6 shows a rear view of the toy vehicle 20 including the power source 46 arranged in the main body 44 of the chassis 22. A plurality of heat vents 82 may be formed in the main body 44 to prevent overheating of the power source 46 and corresponding electronics, such as a printed circuit board, during operation. The power source 46 may also include a USB port 83 to enable charging of the battery or power source 46 via a USB cable. Other plugs or battery charging features may be implemented in the main body 44 of the chassis 22.

Figure 7:
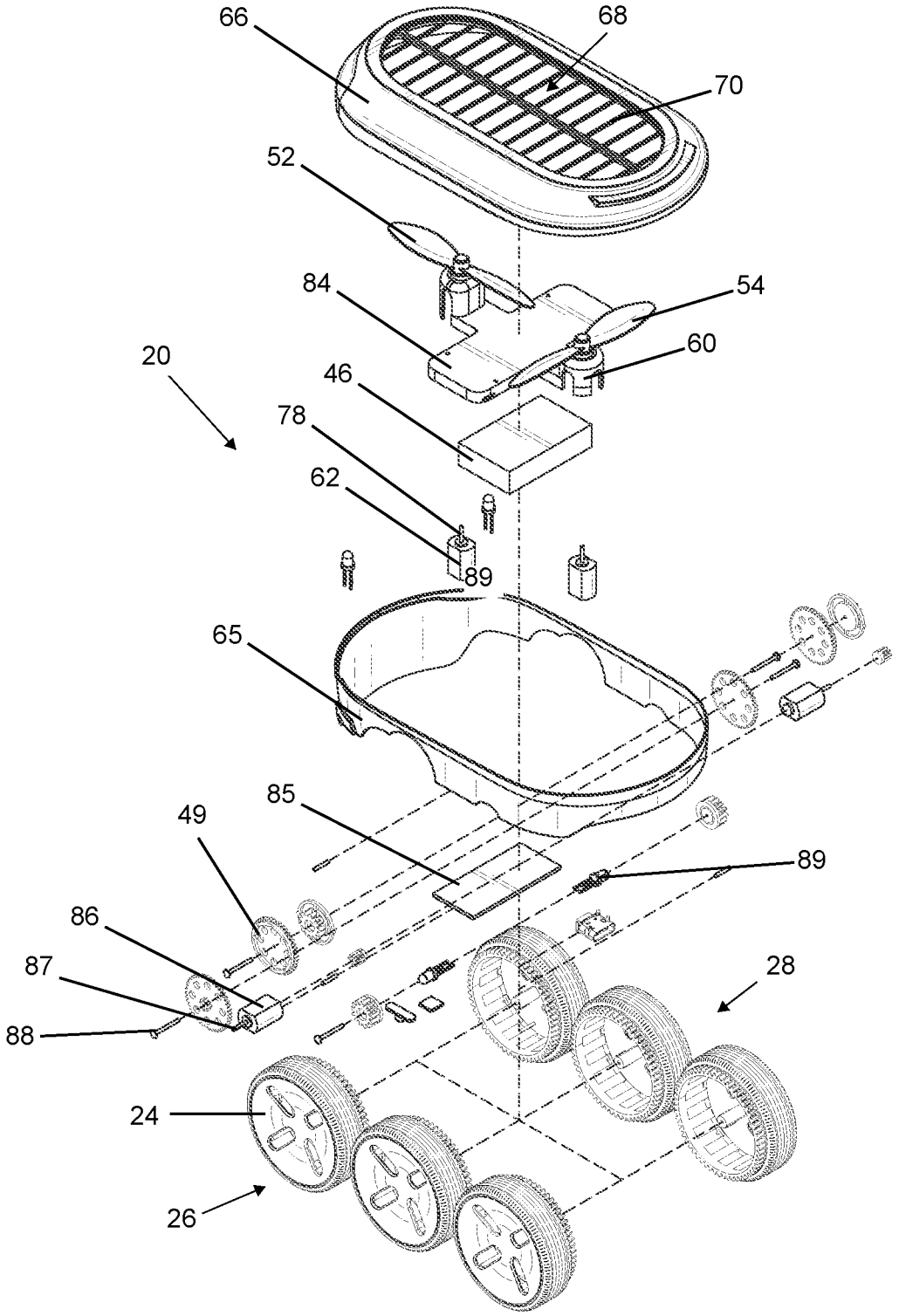
FIG. 7 shows an oblique exploded view of the toy vehicle of FIG. 1.
Figure 8:
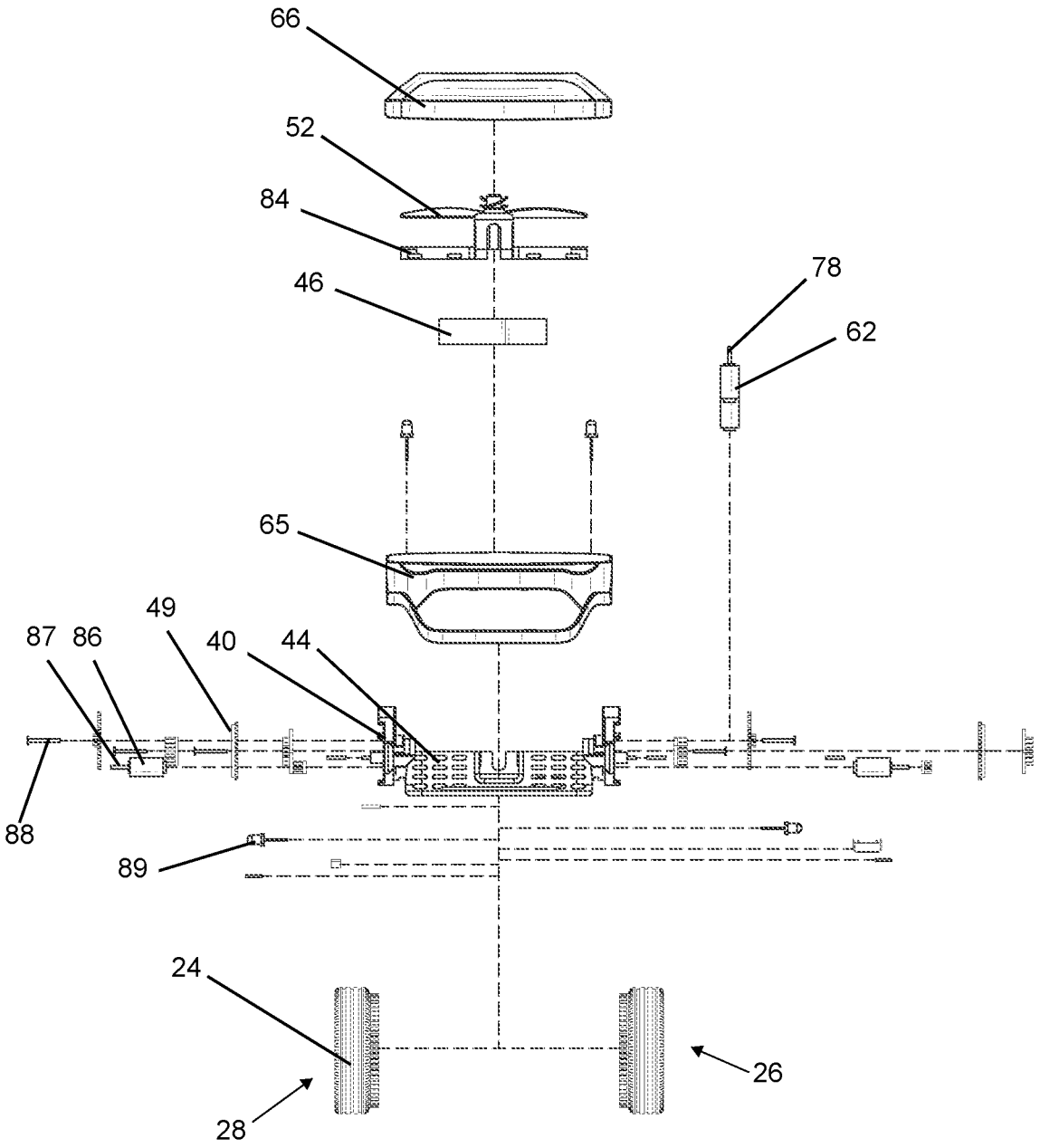
FIG. 8 shows a front exploded view of the toy vehicle of FIG. 1.

FIGS. 7 and 8 show exploded views of the toy vehicle 20 of FIGS. 1-6. FIG. 7 shows an oblique exploded view and FIG. 8 shows a front exploded view. The toy vehicle 20 includes the propellers 52, 54 that each have a corresponding propeller motor 62 and propeller shaft 78 that extends from the propeller motor 62. As shown in FIG. 7, the protective casing 66 for the propellers 52, 54 is configured to cover the entire plane of rotation for the propellers 52, 54 and includes the grid frame having bars 70 that define air passage openings 68. The propeller housings 60 are formed as part of a unitary frame 84 that is connectable with the main body 44 of the chassis 22. The frame 84 is substantially planar between the cylindrical propeller housings 60. Each propeller housing 60 extends perpendicular to the planar portion of the frame 84 and is configured to support a corresponding propeller 52, 54.

The power source 46 for the toy vehicle 20 includes the battery and a printed circuit board 85, as shown in FIG. 7, that are arranged in the main body 44 of the chassis, as shown in FIG. 8. FIGS. 7 and 8 both show the drive motors 86 and drive shafts 87 for the wheels 24. The gear wheel arrangement including gear wheels 49 for connection between the drive shaft 87 and a corresponding wheel 24 is also shown. The gear wheels 49 in the arrangement have different sizes. The drive motors 86 are arranged to extend perpendicular to the direction in which the propeller motors 62 extend. Various axles 88 and connectors 89 or fasteners are also provided to connect and secure the components.

Any suitable materials and manufacturing methods may be used to form the toy vehicle and components thereof. Injection molding, 3D printing, or any other suitable manufacturing process may be used to form any of the housing components.

Figure 9:
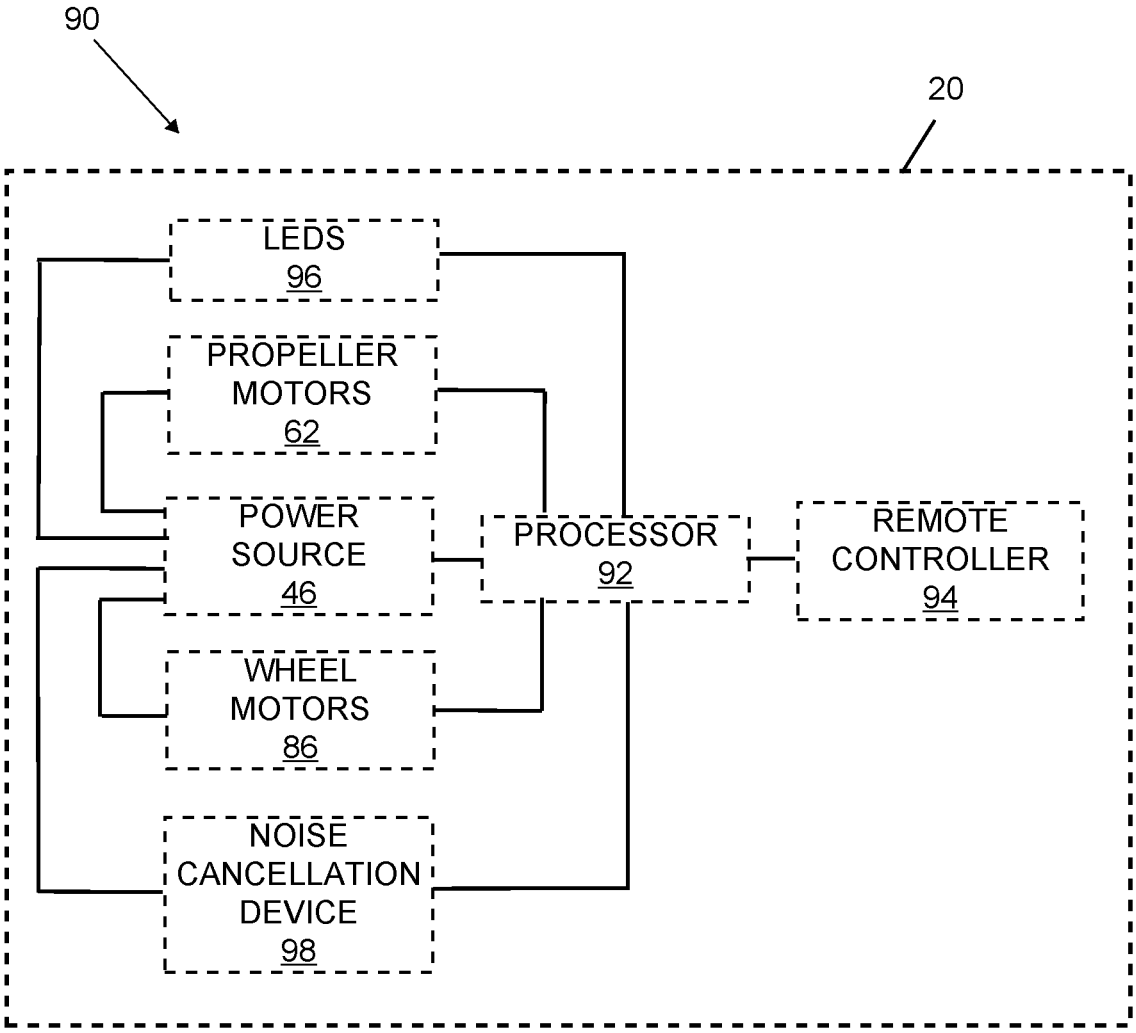
FIG. 9 shows an exemplary control system for the toy vehicle of FIG. 1.

Referring now to FIG. 9, an exemplary control system 90 for the toy vehicle 20 is shown. Components of the control system 90 may be arranged in the main body 44 of the chassis 22 (shown in FIGS. 1-8). The control system 90 includes any suitable processor 92. For example, the processor 92 may be a printed circuit board containing a central processing unit and any suitable circuitry. The processor 92 is configured for wireless communication with a remote controller 94 that may be operable by a user. For example, the processor 92 may include a receiver that receives radio waves from a transmitter in the remote controller 94. The processor 92 is communicatively coupled to the power source 46, which may be a rechargeable battery, the propeller motors 62, and the wheel drive motors 86 for driving the wheels 24. In response to the signals received from the transmitter, the receiver in the processor 92 is configured to operate the toy vehicle 20 accordingly.

The control system 90 may include any other suitable components for the toy vehicle 20, such as sensors, light sources, sound systems, electronics cooling devices, etc. For example, the toy vehicle 20 may have light-emitting diodes (LEDs) 96 that are disposed about the toy vehicle 20 and configured to operate during movement of the toy vehicle 20. The LEDs 96 may be powered by the power source 46. The toy vehicle 20 may advantageously include a noise cancellation device 98 that is configured to reduce the noise emitted by the propellers 52, 54. Any suitable noise cancellation device 98 may be used and the noise cancellation device 98 may be powered by the power source 46. The noise cancellation device 98 may be sized for accommodation in the main body 44 of the chassis 22.

A toy vehicle includes a chassis, a plurality of wheels connected to an exterior of the chassis and configured to move on a surface, at least two propellers connected to an interior of the chassis independently from the plurality of wheels, the at least two propellers being configured to counterrotate relative to each other thereby generating airflow outwardly from the chassis in a first direction that is normal to a rotational plane of the at least two propellers whereby the toy vehicle is urged in a second direction opposite the first direction against the surface, at least one first drive motor operatively connected to the plurality of wheels, and at least one second drive motor operatively connected to the at least two propellers.

The toy vehicle may include at least one propeller housing that is connected to the chassis and is configured to position the at least two propellers relative to the chassis.

The at least one propeller housing may include a unitary frame including two propeller housings that is connected to the chassis.

The at least two propellers may be spaced and aligned along a central axis of the toy vehicle.

Drive shafts of the at least two second drive motors may extend perpendicular relative to a drive shaft of the at least one first drive motor.

The toy vehicle may include a protective casing arranged over the at least two propellers, with the at least two second drive motors extending from the chassis toward the protective casing.

The protective casing may extend over an entire rotational area of each of the at least two propellers.

The protective casing has at least one propeller opening that enables passage of the airflow.

The protective casing may include a grid frame formed of a plurality of rigid bars defining a plurality of propeller openings.

All of the plurality of wheels may be arranged outside an outer perimeter of the protective casing.

A rotational plane of the plurality of wheels may be outside the protective casing and a rotational plane of the at least two propellers may be inside the protective casing.

The toy vehicle may include a chassis casing that is removably attachable to the protective casing and surrounds a propeller housing that houses the at least two second drive motors.

The chassis casing may have a front panel that extends in front of the chassis.

The toy vehicle may include side brackets that each have one set of wheels mounted thereto, and gear wheels that are supported by the side brackets and connected between the at least one first drive motor and at least one of the plurality of wheels.

The plurality of wheels may include a first and second set of wheels arranged on opposing sides of the chassis that each include three or more wheels.

The three or more wheels may be identical in shape and size, each of the three or more wheels being uniformly mounted relative to the chassis.

Each of the wheels may have a same diameter that is greater than half of an entire height of the toy vehicle.

The toy vehicle may include a control system including a noise cancellation device for the at least two propellers.

The toy vehicle may include a light-emitting diode light pipe extending along a front and a bottom of the chassis.

A method of assembling a toy vehicle includes connecting a plurality of wheels to an exterior of a chassis, the plurality of wheels being configured to move on a surface, mounting at least two propellers to an interior of the chassis independently from the plurality of wheels, the at least two propellers being configured to counterrotate relative to each other thereby generating airflow outwardly from the chassis in a first direction that is normal to a rotational plane of the at least two propellers whereby the chassis is urged in a second direction opposite the first direction against the surface, operatively connecting at least one first drive motor to the plurality of wheels, and operatively connecting at least one second drive motor to the at least two propellers.

The method may include arranging protective casings to cover and protect the at least two propellers and to surround and protect a propeller housing that houses the at least two second drive motors.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A toy vehicle comprising:

a chassis;

a plurality of wheels connected to an exterior of the chassis and configured to move on a surface, wherein the chassis is configured to define an underbody area of the toy vehicle that is between an undersurface of the chassis and the surface, the underbody area being open on all sides whereby the underbody area is ductless along an airflow path through the underbody area between a front side of the toy vehicle and a back side of the toy vehicle;

at least two propellers connected to an interior of the chassis independently from the plurality of wheels, the at least two propellers being configured to counterrotate relative to each other thereby generating airflow outwardly from the chassis in a first direction that is normal to a rotational plane of the at least two propellers whereby the toy vehicle is urged in a second direction opposite the first direction against the surface, the at least two propellers being configured to urge the toy vehicle against the surface and being capable of maintaining the vehicle against the surface when the surface is a vertical surface, the toy vehicle being configured to transition from a horizontal surface to the vertical surface, wherein the at least two propellers define a rotational area that is larger than a surface area defined by the chassis in a plane that is parallel with the rotational plane of the at least two propellers;

at least one first drive motor operatively connected to the plurality of wheels; and at least one second drive motor operatively connected to the at least two propellers.

2. The toy vehicle according to claim 1 further comprising at least one propeller housing that is connected to the chassis and is configured to position the at least two propellers relative to the chassis.

3. The toy vehicle according to claim 2, wherein the at least one propeller housing includes two propeller housings formed as part of a unitary frame that is connected to the chassis.

4. The toy vehicle according to claim 1, wherein the at least two propellers are spaced and aligned along a central axis of the toy vehicle.

5. The toy vehicle according to claim 1, wherein a drive shaft of the at least one second drive motor extends perpendicular relative to a drive shaft of the at least one first drive motor.

6. The toy vehicle according to any claim 1 further comprising a protective casing arranged over the at least two propellers, wherein the at least one second drive motor extends from the chassis toward the protective casing.

7. The toy vehicle according to claim 6, wherein the protective casing extends over an entire rotational area of each of the at least two propellers.

8. The toy vehicle according to claim 6, wherein the protective casing has at least one propeller opening that enables passage of the airflow.

9. The toy vehicle according to claim 8, wherein the protective casing includes a grid frame formed of a plurality of rigid bars defining a plurality of propeller openings.

10. The toy vehicle according to claim 6, wherein a rotational plane of the plurality of wheels is outside the protective casing and a rotational plane of the at least two propellers is inside the protective casing.

11. The toy vehicle according to claim 6 further comprising a chassis casing that is removably attachable to the protective casing and surrounds a propeller housing that houses the at least one second drive motor.

12. The toy vehicle according to claim 1 further comprising side brackets that each have one set of wheels mounted thereto, and gear wheels that are supported by the side brackets and connected between the at least one first drive motor and at least one of the plurality of wheels.

13. The toy vehicle according to claim 1, wherein the plurality of wheels includes a first and second set of wheels arranged on opposing sides of the chassis that each include three or more wheels.

14. The toy vehicle according to claim 13, wherein the three or more wheels are identical in shape and size, each of the three or more wheels being uniformly mounted relative to the chassis, wherein each of the wheels has a same diameter that is greater than half of an entire height of the toy vehicle.

15. The toy vehicle according to claim 1 further comprising a control system including a noise cancellation device for the at least two propellers.

16. The toy vehicle according to claim 1 further comprising a light-emitting diode light pipe extending along a front and a bottom of the chassis.

17. The toy vehicle according to claim 1, wherein at least one of the front side of the toy vehicle and the back side of the toy vehicle has at least one light, and where the front side of the vehicle and the back side of the toy vehicle have different light configurations.

18. The toy vehicle according to claim 4, wherein the central axis extends from the front side of the toy vehicle to the back side of the toy vehicle.

19. A method of assembling a toy vehicle, the method comprising:

connecting a plurality of wheels to an exterior of a chassis, the plurality of wheels being configured to move on a surface, wherein the chassis is configured to define an underbody area of the toy vehicle that is between an undersurface of the chassis and the surface, the underbody area being open on all sides whereby the underbody area is ductless along an airflow path through the underbody area between a front side of the toy vehicle and a back side of the toy vehicle;

mounting at least two propellers to an interior of the chassis independently from the plurality of wheels, the at least two propellers being configured to counterrotate relative to each other thereby generating airflow outwardly from the chassis in a first direction that is normal to a rotational plane of the at least two propellers whereby the chassis is urged in a second direction opposite the first direction against the surface, the at least two propellers being configured to urge the toy vehicle against the surface and being capable of maintaining the vehicle against the surface when the surface is a vertical surface, the toy vehicle being configured to transition from a horizontal surface to the vertical surface, wherein the at least two propellers define a rotational area that is larger than a surface area defined by the chassis in a plane that is parallel with the rotational plane of the at least two propellers;

operatively connecting at least one first drive motor to the plurality of wheels; and operatively connecting at least one second drive motor to the at least two propellers.

* * * * *